United States Patent [19]

Hochholzer

[11] Patent Number: 4,845,461

[45] Date of Patent: Jul. 4, 1989

[54] POTENTIOMETER

[75] Inventor: Reinhard Hochholzer, Höhenkirchen, Fed. Rep. of Germany

[73] Assignee: Wilhelm Ruf KG, Munich, Fed. Rep. of Germany

[21] Appl. No.: 79,833

[22] Filed: Jul. 30, 1987

[30] Foreign Application Priority Data

Aug. 27, 1986 [DE] Fed. Rep. of Germany ..... 3629002

[51] Int. Cl.[4] ..... H01C 1/12

[52] U.S. Cl. ..... 338/202; 338/190

[58] Field of Search ..... 338/202, 167, 154, 190–194

[56] References Cited

U.S. PATENT DOCUMENTS 3,188,407 6/1965 Avgerinos ..... 200/24

3,982,221 9/1976 Smith ..... 338/202

4,572,599 2/1986 Pryputniewicz et al. ..... 338/202 X

FOREIGN PATENT DOCUMENTS 2406291 8/1974 Fed. Rep. of Germany .

*Primary Examiner*—E. A. Goldberg

*Assistant Examiner*—M. M. Lateef

*Attorney, Agent, or Firm*—Helfgott & Karas

[57] ABSTRACT

A potentiometer has a substantially rectilinear slide spring (2) which rests on a defined inclined support surface (4) of the spring carrier (1), being supported, in one direction, at the front edge (7) of this support surface and, in the other direction, projecting into a recess (5) of the spring carrier serving as a thrust bearing for the vertical force. The slide spring (2) is anchored firmly on the spring carrier by means of a tongue (12) bent upwardly and by a post (13) of the spring carrier.

7 Claims, 3 Drawing Sheets

1
2
3
4
5
6
7
8
9
10
11
12
12'
13
14
15
α

FIG. 7
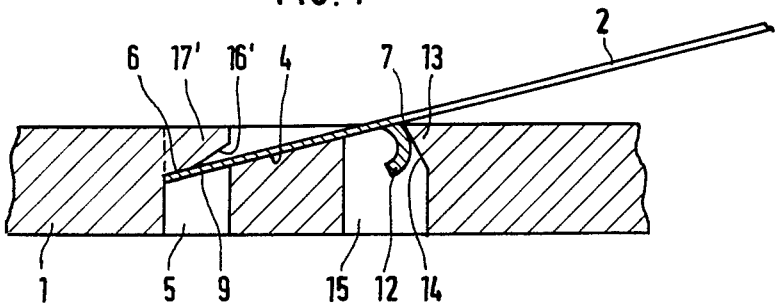
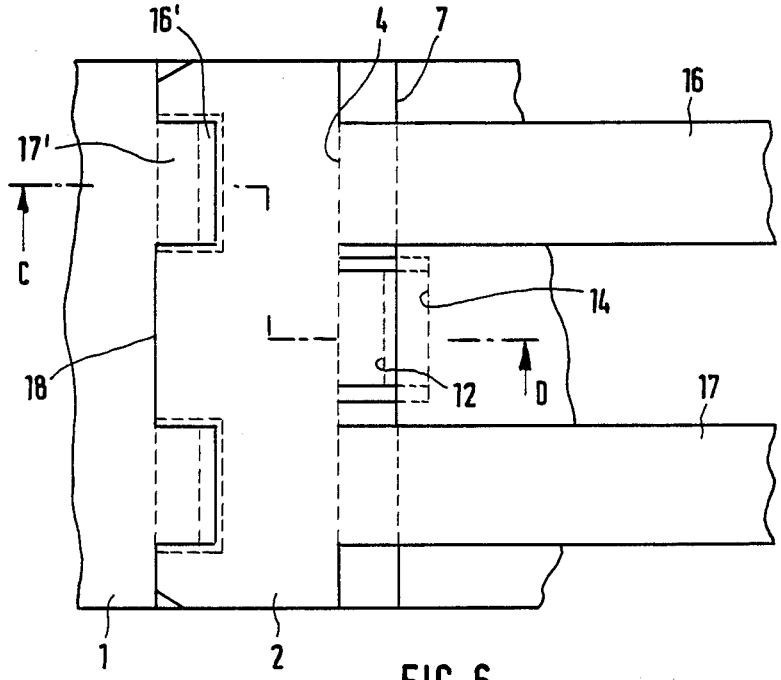
FIG. 6

POTENTIOMETER

The instant invention relates to a potentiometer, comprising a resistance plate, a slide spring whose front end is in sliding electrical contact with a resistance layer applied on the resistance plate, and a spring carrier which is rotatable or movable with respect to the resistance plate and at which the rear end of the slide spring is fixed.

Such potentiometers are widely available commercially. With these known potentiometers there is a problem as regards the adjustment of the contact pressure of the slide spring against the resistance plate. In practice, this spring pressure is adjusted by bending the slide spring which already is attached firmly (e.g. riveted) to the spring carrier until it has the "proper" curvature so that the contact pressure will be within predetermined limit values. This "setting" makes it necessary to stress the slide spring beyond its yield point. That, in turn, changes the spring characteristics of the slide spring, a phenomenon which may be explained by structural changes taking place inside the material when the stretching-strain limit is exceeded. Moreover such adjustment requires a great amount of work and a lot of "feel" for it. More or less completely automatic assembly of such potentiometers, therefore, is out of the question.

It is, therefore, an object of the invention to improve the potentiometer of the kind specified initially such that the contact pressure of the slide spring against the resistance layer can be determined very precisely, at small technical expenditure.

This object is met, in accordance with the invention, in that the slide spring is of substantially rectilinear configuration, in that the spring carrier has a support surface which is inclined with respect to the resistance plate and on which part of the slide spring rests, and in that the spring carrier includes a thrust bearing which prevents lift-off of the rear end of the slide spring from the support surface.

Advantageous modifications and further developments of the invention may be gathered from the subclaims.

It is thus the basic concept of the invention that the slide spring is rectilinear and rests on a defined inclined surface of the spring carrier. In one direction the slide spring thus is supported at the front end of this inclined surface. And, in the other direction, it is supported in a recess or "tunnel" of the spring carrier which serves as a thrust bearing for the force acting in upward direction.

Furthermore, the invention offers the following advantages: the assembly costs are low (expenses as to time and parts) because all that is left to be done is to insert the slide spring in the spring carrier; no fastening by rivets, screws and the like is required; no additional structural members are needed to fasten the spring; practically no forces which might deform the slide spring must be applied to mount or fasten the slide spring on the spring carrier; no readjustment is needed of the spring pressure; the contact pressure is obtained within very close tolerances; after preassembly already, the slide spring is clamped to the spring carrier such that it cannot get lost; finally, the slide spring is retained at the spring carrier in a precisely defined position.

The invention will be described further, by way of example, with reference to the accompanying drawings, in which:

FIG. 6 is a top plan view of a spring carrier with a slide spring fixed to it, according to a third embodiment of the invention; and FIG. 7 is a sectional elevation along lines C–D in FIG. 6.

Figures 1, 2, 3:
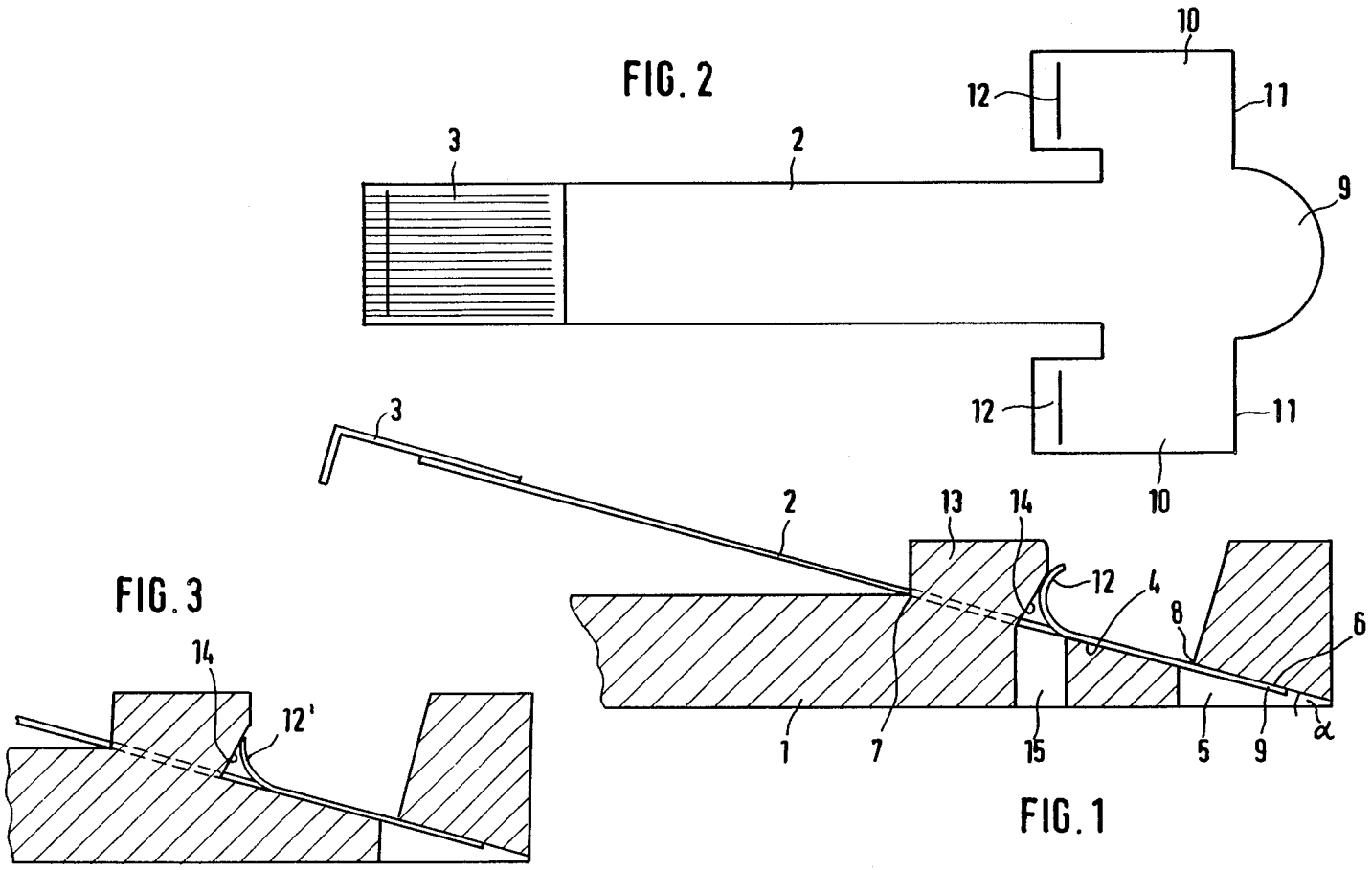
FIG. 1 is a sectional elevation of a spring carrier with a slide spring fixed to it, according to one embodiment of the invention.
FIG. 2 is a top plan view of the slide spring shown in FIG. 1.
FIG. 3 is a part sectional elevation similar to FIG. 1 of another variant of the invention.

The resistance plate, casing, rotary actuating members, and electrical terminals which, of course, the potentiometer comprises are left out from the drawing in order to illustrate the essential features of the invention more clearly. It presents no difficulty to those skilled in the art to adapt those elements to the invention in accordance with known prototypes.

FIG. 1 shows a cross section of a spring carrier 1 into which a slide spring 2 has been inserted which includes slide brushes 3 at its front end. When assembly has been completed of the potentiometer, these slide brushes 3 are in sliding electrical contact with a resistance layer of a resistance plate. The slide spring 2 is rectilinear on the whole. To be able to apply a defined contact pressure on the resistance layer, the spring, of course, must be bent somewhat in the ready assembled stated of the potentiometer. Yet this bending is limited to the range of spring elasticity or the range which obeys Hooke's law. The spring carrier 1 comprises a support surface 4 which extends at an inclination with respect to the resistance plate and on which rests part (the rear portion) of the slide spring. The inclination (angle $\alpha$) of this support surface is defined exactly. Therefore, the contact pressure between the slide spring and the resistant layer can be predetermined precisely by the angle $\alpha$, the length of the slide spring 2, and the vertical distance between the spring carrier and the resistance plate and, finally, the properties of the material (spring characteristic). This means that any "readjustment" is superfluous.

The rear end of the slide spring is supported in a thrust bearing of the spring carrier so as to prevent it from being lifted off the spring carrier when the front end of the slide spring touches the resistance plate. The thrust bearing is embodied by a recess 5 which directly follows the support surface 4 and the wall 6 of which facing the upper side of the slide spring likewise is inclined at the angle $\alpha$. The distance between the two planes in which lie the support surface 4 and the wall 6, respectively, is so selected as to be the same as the thickness of the material of the slide spring 2, as this will assure a kind of supporting practically without clearance. The slide spring thus is clamped at two precisely defined lines, namely at the front edge 7 of the support surface 4, on the one hand, and at the front edge 8 of the wall 6, on the other hand, even if the slide spring should lift off from the support surface 4 upon deformation caused by the contact pressure of the resistance plate.

Precise alignment of the slide spring with respect to the spring carrier in longitudinal direction as well is obtained by defined abutment surfaces which the spring carrier shown in FIG. 1 has at both sides adjacent the recess 5 and which are aligned with the edge 8. At its rear end the slide spring accordingly has two lateral arms 10 with backwardly facing edges 11 which are supported on the spring carrier.

The slide spring is fixed in position on the spring carrier for final assembly by upwardly bent tongues 12 which are formed at the forwardly directed ends of the two arms 10 and supported on upwardly projecting posts 13, more specifically at the rearwardly facing wall 14 thereof.

This wall 14 is inclined towards the tongue 12 and the angle it includes with the support surface thus is smaller than 90°. In the embodiment shown in FIGS. 1 and 2, the posts 13 are arranged at both sides adjacent the support surface and opposed to the two tongues 12 of the slide spring 2.

In the case of the embodiment shown in FIG. 1 the tongue is bent approximately into circular shape, the bent portion abutting against the wall 14. The inclination of the wall 14 permits snap fitting of the tongue, a resulting force acting on the slide spring to press the same in downward direction against the support surface and backwards. As the bent portion of the tongue 12 is held in engagement with the wall 14, it is easy to remove the slide spring in upward direction.

The embodiment according to FIG. 3 differs from the above in that the tongue 12' is shorter, thus engaging the wall 14 by its upper edge. Since this is a rather sharp upper edge, it grips the wall, in other words the upper edge digs slightly into the plastic material so that the slide spring cannot be taken out easily. Rather, a tool would be required for removal to bend the tongue 12' upwardly a little. Otherwise the embodiment shown in FIG. 3 corresponds to the one according to FIG. 1.

In FIG. 1 another opening 15 may be seen in the spring carrier. Its purpose is to facilitate removal of the spring carrier from the injection mold.

It may be gathered from FIG. 2 that the rear portion 9 of the slide spring abutting against the wall 6 is semicircular, as seen from the top. It is obvious that this portion also may be rectangular.

Figure 5:
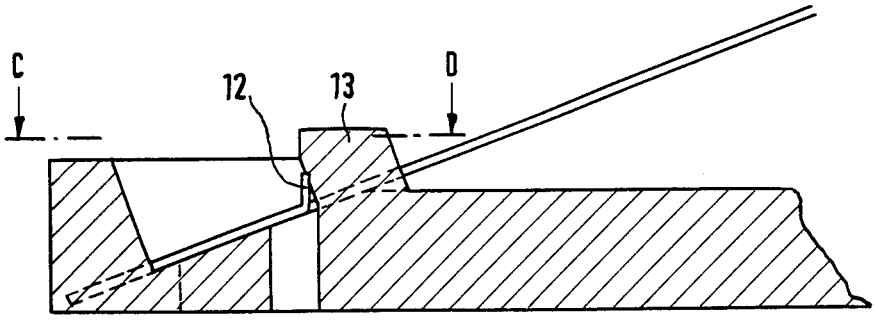
FIG. 5 is a sectional elevation along lines A–B in FIG. 4.
Figure 4:
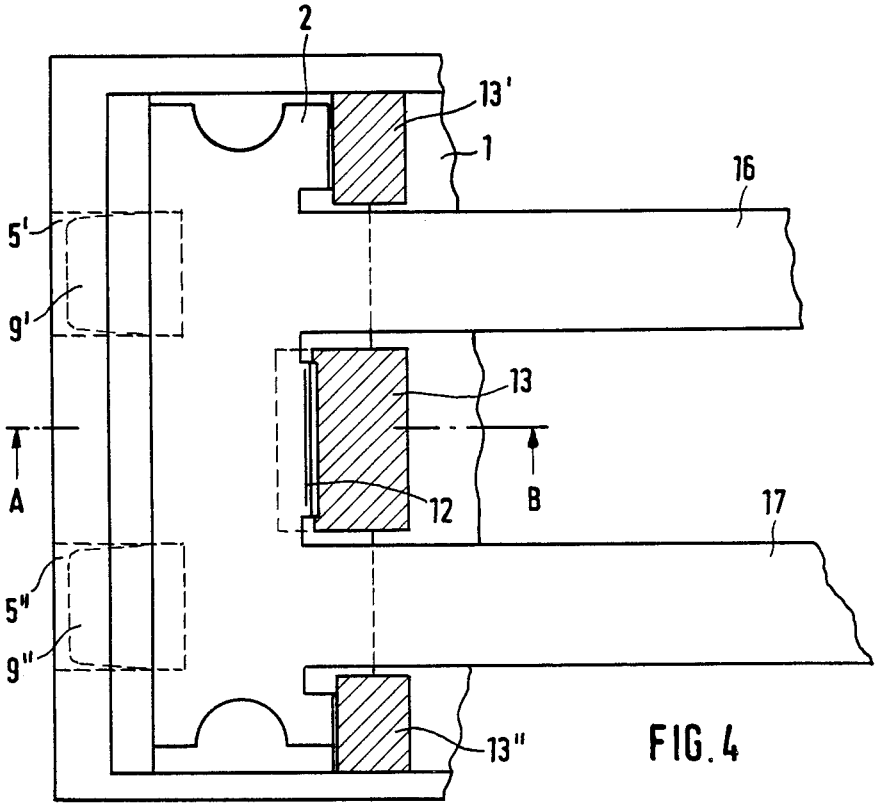
FIG. 4 is a top plan view, partly in section, of a spring carrier with a slide spring fixed to it, according to a second embodiment of the invention.

In the embodiment illustrated in FIGS. 4 and 5 the slide spring has two spaced arms 16 and 17 extending in parallel.

In analogy with the embodiment according to FIGS. 1 to 3, recesses 5' and 5'' are provided in the extension of the two arms 16 and 17, and they are engaged by portions 9' and 9'', respectively. It is possible to provide one central post 13 for fixing the slide spring 2 in position on the spring carrier 1. This post would be located between the two arms 16 and 17 so that only one tongue 12 is needed. However, it is likewise conceivable to provide posts at both sides of the arms 16 and 17, in other words additional posts 13' and 13''. In that case the spring carrier comprises corresponding upwardly bent tongues at those locations as well. They are not shown in FIG. 4. In conclusion, it should be noted that FIG. 4 is a section along line C–D in FIG. 5 and, vice versa, FIG. 5 is a section along line A–B in FIG. 4. As may be taken from FIG. 5, the tongue also may be rectilinear, whereby its front edge digs into the post even more pronouncedly. This becomes evident especially from FIG. 5.

The embodiment illustrated in FIGS. 6 and 7 substantially differs from the one according to FIGS. 4 and 5 in that the post 13 no longer protrudes above the upper edge of the spring carrier 1. Instead, it is essentially flush with the same, and the tongue 12 projects in downward direction into the recess 15 formed in the spring carrier. There it rests against the inclined wall 14 of the "post" 13. In this case the edge 7 of the post 13 may extend across the full width of the spring carrier, thus providing support also for the spring arms 16 and 17 in addition to the support offered by the support surface 4.

Another difference between FIGS. 6 and 7 and the embodiment according to FIGS. 4 and 5 resides in the rear thrust bearing for the spring. This is of such design that the recess 5 (FIG. 7) is covered by cantilever-type portions 17'. Again, downwardly facing wall of portion 17' extends parallel to the support surface 4. The introduction of the spring is facilitated by an inclination 16' formed in portion 17' and extending at an acute angle with respect to the direction of the spring. In this embodiment the spring has no lugs extending rearwardly of its main body but instead a continuous straight edge 18.

All the technical details shown in the claims, specification, and drawing may be essential of the invention, both individually and in any desired combination.

What is claimed is:

1. A potentiometer comprising:

a resistance plate having a resistance layer;

a slide spring having a substantially rectilinear configuration, said spring having a front end which is in sliding electrical contact with said layer and a rear end, said spring having a tongue extending outwardly therefrom and disposed intermediate the front and rear ends;

a spring carrier movable with respect to the plate and having a support surface which is inclined with respect to the resistance plate, said spring resting on said surface, said carrier having a recess extending therein with an opening flush with said surface, said recess constituting a thrust bearing, the rear end of the spring being supported in said bearing, said bearing preventing the rear end from being lifted off the carrier when the front end engages the plate, said carrier having a stop adjacent the recess and a post disposed intermediate the front and rear ends of the spring and spaced from the stop, said post having a surface engaged by the tongue, the post surface engaged by the tongue being inclined with respect to the carrier support surface so that the spring is forced against the support surface and engages the stop.

2. The potentiometer as claimed in claim 1, characterized in that the tongue (12) is bent radius-like.

3. The potentiometer as claimed in claim 1, characterized in that the tongue abuts against a wall (14) of the post (13) by an edge of its free end.

4. The potentiometer as claimed in claim 3, characterized in that posts (13;13';13'') are provided at both sides of the slide spring (2) to support corresponding tongues of the slide spring.

5. The potentiometer as claimed in claim 4, characterized in that the slide spring includes two slide arms (16 and 17), the spring carrier comprising a post (13) between the same for support of the tongue (12).

6. The potentiometer as claimed in claim 5, characterized in that the tongue (12) is bent such that is directed away from the support surface (4).

7. The potentiometer as claimed in claim 5, characterized in that the tongue (12) is bent such that it projects into the interior of the spring carrier (2), at least one edge of the post (13) being aligned with the support surface (4).

* * * * *